US011653783B2

(12) United States Patent
Tan et al.

(10) Patent No.: US 11,653,783 B2
(45) Date of Patent: May 23, 2023

(54) TELESCOPIC RAIL

(71) Applicant: Guangdong Raex Intelligent Technology Co., Ltd., Guangzhou (CN)

(72) Inventors: Jinbin Tan, Guangzhou (CN); Weiping Chen, Guangzhou (CN)

(73) Assignee: Guangdong Raex Intelligent Technology Co., Ltd., Guangzhou (CN)

( * ) Notice: Subject to any disclaimer, the term of this patent is extended or adjusted under 35 U.S.C. 154(b) by 105 days.

(21) Appl. No.: 17/288,322

(22) PCT Filed: Dec. 31, 2019

(86) PCT No.: PCT/CN2019/130340
§ 371 (c)(1),
(2) Date: Apr. 23, 2021

(87) PCT Pub. No.: WO2021/056919
PCT Pub. Date: Apr. 1, 2021

(65) Prior Publication Data

US 2021/0369034 A1 Dec. 2, 2021

(30) Foreign Application Priority Data

Sep. 26, 2019 (CN) ..... 201921622312.0

(51) Int. Cl.
*A47H 1/08* (2006.01)
*A47H 15/00* (2006.01)
(Continued)

(52) U.S. Cl.
CPC ..... *A47H 1/08* (2013.01); *A47H 15/00* (2013.01); *E05D 15/06* (2013.01); *E05F 3/16* (2013.01)

(58) Field of Classification Search
CPC A47H 1/08; A47H 15/00; E05D 15/06; E05F 3/16
See application file for complete search history.

(56) References Cited

U.S. PATENT DOCUMENTS 7,810,219 B2 * 10/2010 Lindemann ..... F16G 3/08 24/37
8,708,026 B2 * 4/2014 Graves ..... A47H 5/0325 160/330
(Continued)

FOREIGN PATENT DOCUMENTS

CN 2516065 Y 10/2002
CN 104066361 A 9/2014
(Continued)

OTHER PUBLICATIONS

International Search Report dated Jun. 23, 2020 for International Patent Application No. PCT/CN2019/130340.

*Primary Examiner* — Victor D Batson
*Assistant Examiner* — Matthew J Sullivan

(57) ABSTRACT

Provided is a telescopic rail, comprising a first rail and a second rail slidably arranged relative to each other, two rotating wheels, a belt, a first and a second traction block. When the rail is put into use, loosen the first and the second fixing device to release the belt from the first and the second traction block, then slide the first and the second rail relative to each other till the total length of the rails is qualified for the installation requirement, then tighten the first and the second fixing device to grip the belt by the first and the second traction block, after that cut off the surplus of belt, thus the length of the telescopic rail could be adjusted on-site without preparatory measurements and customizations, which decreases the workload for measurements and improves the efficiency for installation.

8 Claims, 4 Drawing Sheets

(51) Int. Cl.
*E05D 15/06* (2006.01)
*E05F 3/16* (2006.01)

(56) References Cited

U.S. PATENT DOCUMENTS

| | | | | |
|---|---|---|---|---|
| 2021/0393067 | A1* | 12/2021 | Chen | A47H 1/08 |
| 2022/0087466 | A1* | 3/2022 | Jiang | A47H 1/08 |

FOREIGN PATENT DOCUMENTS

| | | | |
|---|---|---|---|
| CN | 205493469 | U | 8/2016 |
| CN | 208551018 | U | 3/2019 |
| CN | 110786711 | A | 2/2020 |
| JP | 2003310422 | A | 11/2003 |

* cited by examiner

A-A

B-B

C-C

D-D

TELESCOPIC RAIL

CROSS REFERENCE TO RELATED APPLICATION

This application claims priority to PCT Application PCT/CN2019/130340 filed on Dec. 31, 2019, which is based on Chinese Application No. 201921622312.0 filed on Sep. 26, 2019, under U.S.C. § 119, the entire contents of which are hereby incorporated by reference.

TECHNICAL FIELD

The following relates to the field of a curtain, in particular to the field of a telescopic rail for curtain.

BACKGROUND OF INVENTION

Curtain is houseware installed at the window for light-shading. Generally, windows are provided in different sizes. Therefore, the width of the windows needed to be measured before curtains being produced and installed, such that curtain rails could be produced in accordance with the measurements. Such method is disadvantageous in that, on-site measurement is required, which costs lots of labor.

SUMMARY OF THE INVENTION

It is an object of an aspect of the invention to provide a telescopic rail of which the belt is allowed to be trimmed.

According to an aspect related to the invention, provided is a telescopic rail, comprising rails, two rotating wheels, a belt, a first traction block, and a second traction block. The rails include a first rail and a second rail which is slidably arranged inside the first rail; the two rotating wheels are respectively arranged at the two ends of the rails; the belt, which wraps around the outer periphery of the two rotating wheels, has a free end and a fixed end; the first traction block is arranged at the middle of the belt, wherein the first traction block comprises a first fixing device by which the first traction block could grip or release the belt; the second traction block is configured to grip the two ends of the belt, wherein the fixed end is gripped and fixed by the second traction block, and the free end is gripped by the second traction block and then stretches out of the second rail via a through-hole on the second rail, wherein the second traction block comprises a second fixing device by which the second traction block could grip or release the belt.

In a further aspect of the invention, the belt is a timing belt.

In a further aspect of the invention, the first traction block comprises a first main part and a first retaining structure, the first retaining structure comprises a first fixing plate and a first gripping portion for gripping the belt, wherein the belt is gripped between the first main part and the first gripping portion, the first fixing plate is fixed with the first main part by the first fixing device.

In a further aspect of the invention, the first main part comprises a first groove portion installed inside the rail and a first fixing portion partly extended out of the rail, wherein the first fixing portion is fixed with the first fixing plate by the first fixing device, and the belt is gripped in the first groove portion.

In a further aspect of the invention, the first fixing device is a screw.

In a further aspect of the invention, the second traction block comprises a second main part and a second retaining structure, the second retaining structure comprises a second fixing plate and a second gripping portion for gripping the belt, wherein the belt is gripped between the second main part and the second gripping portion, the second fixing plate is fixed with the second main part by the second fixing device.

In a further aspect of the invention, the second main part comprises a second groove portion installed inside the rail and a second fixing portion partly extended out of the rail, wherein the second fixing portion is fixed with the second fixing plate by the second fixing device, and the belt is gripped in the second groove portion.

In a further aspect of the invention, the second fixing device is a screw.

The present invention has following technical advantages:

The telescopic rail comprises a first rail and a second rail slidably arranged relative to each other, rotating wheels, a belt, a first traction block, and a second traction block. When the rail is put into use, loosen the first fixing device and the second fixing device to release the belt from the first traction block and the second traction block, then hold the free end of the belt and slide the first rail and the second rail relative to each other till the total length of the rails is qualified for the installation requirement, then tighten the first fixing device and the second fixing device to grip and secure the belt by the first traction block and the second traction block, after that cut off the surplus of belt extending out of the through-hole, thus the length of the telescopic rail could be adjusted on-site without preparatory measurements and customizations, which decreases the workload for measurements and improves the efficiency for installation.

BRIEF DESCRIPTION OF DRAWINGS

The present invention will be described hereinafter in details with reference to the figures and the embodiments, wherein.

REFERENCE LIST

Figure 1:
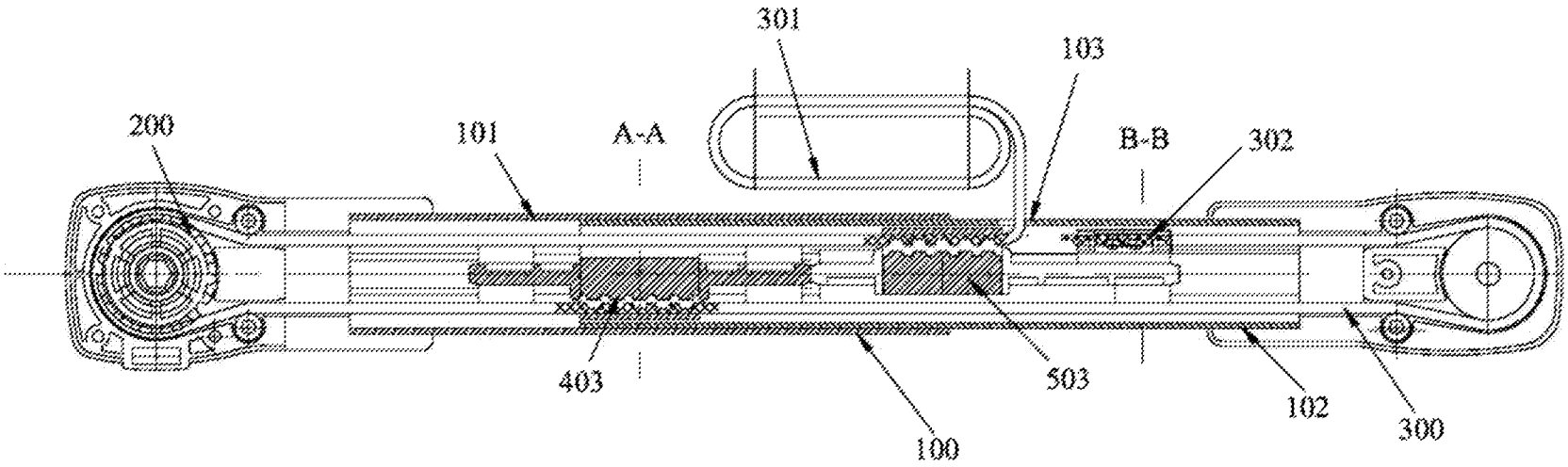
FIG. 1 is a cross sectional view of a telescopic rail in contractive state of an embodiment according to the present invention.

Rail 100;
First rail 101;
Second rail 102;
Through-hole 103;
Rotating wheel 200;
Belt 300;
Free end 301;
Fixed end 302;
First traction block 400;
First fixing device 401;
First main part 402;
First gripping portion 403;
First fixing plate 404;

Second traction block 500;
Second fixing device 501;
Second main part 502;
Second gripping portion 503;
Second fixing plate 504.

DETAILED DESCRIPTION OF THE INVENTION

Certain embodiments of the present invention are described in detail below, with reference to the accompanying drawings. It should be appreciated that the embodiments described here are only provided to describe and explain the present invention, but shall not be deemed as constituting any limitation on the present invention.

All relative descriptions herein such as, up, down, front, back, left, and right are with reference to the Figures, such terms and other directional terms should be interpreted with reference to the figures under discussion. Such terms are not intended as a limitation on the position in which the invention or components may be used, and are not intended as a limitation on the invention.

Numerical terms are not intended as a limitation or to imply a sequence, unless otherwise specified or made apparent by the context of the discussion.

Unless otherwise defined, terms such as "provide", "arrange", "connect" and especially any technical used herein may be understood broadly in connection with the technical solution by those skilled in the art.

Referring to FIGS. 1 to 6, provided is a telescopic rail, comprising rails 100, two rotating wheels 200, a belt 300, a first traction block 400, and a second traction block 500. The rails 100 include a first rail 101 and a second rail 102 with one end slidably arranged inside the first rail 101; the two rotating wheels 200 are respectively arranged at the two ends of the rails 100; the belt 300, which wraps around the outer periphery of the two rotating wheels 200, has a free end 301 and a fixed end 302.

Optionally, the belt 300 is a timing belt.

The first traction block 400 is arranged at the middle of the belt 300, wherein the first traction block 400 comprises a first fixing device 401 by which the first traction block 400 could grip or release the belt 300.

Preferably, the first fixing device 401 is a screw.

Further, the first traction block 400 comprises a first main part 402 and a first retaining structure, the first retaining structure comprises a first fixing plate 404 and a first gripping portion 403 for gripping the belt 300, wherein the belt 300 is gripped between the first main part 402 and the first gripping portion 403, the first fixing plate 404 is fixed with the first main part 402 by the first fixing device 401. In a preferred embodiment, the first retaining structure is integrally-formed or formed by fixing the first fixing plate 404 and the first gripping portion 403 by a screw.

The first main part 402 comprises a first groove portion installed inside the rail 100 and a first fixing portion partly extended out of the rail 100, wherein the first main part 402 is fixed with the first fixing plate 404 at the first fixing portion by the first fixing device 401, and the belt 300 is gripped in the first groove portion.

The second traction block 500 is configured to grip the two ends of the belt 300, wherein the second traction block 500 comprises a second fixing device 501 by which the second traction block 500 could grip or release the belt 300.

In a preferred embodiment, the second fixing device 501 is a screw. The fixed end 302 of the belt 300 is fixed to the second traction block 500, and the free end 301 of the belt 300 extends out of the second rail 102 via a through-hole 103 on the second rail 102.

The telescopic rail comprises a first rail 101 and a second rail 102 slidably arranged relative to each other, rotating wheels 200, a belt 300, a first traction block 400, and a second traction block 500. When the length of the rail needs to be regulated, loosening the first fixing device 401 and the second fixing device 501 to release the belt 300 from the first traction block 400 and the second traction block 500, then holding the free end 301 of the belt 300 and slide the first rail 101 and the second rail 102 relative to each other till the total length of the rails 100 is qualified for the installation requirement, then tightening the first fixing device 401 and the second fixing device 501 to grip and secure the belt 300 by the first traction block 400 and the second traction block 500, after that cutting off the surplus of belt 300 extending out of the through-hole 103. Therefore, the adjustments of the telescopic rail 100 can be done on-site without preparatory measurements and customizations, which decreases the workload for measurements and improves the efficiency for installation.

In an embodiment, the second traction block 500 comprises a second main part 501 and a second retaining structure, the second retaining structure comprises a second fixing plate 504 and a second gripping portion 503 for gripping the belt 300, wherein the belt 300 is gripped between the second main part 502 and the second gripping portion 503, the second fixing plate 504 is fixed with the second main part 502 by the second fixing device 501. Specifically, the second main part 502 comprises a second groove portion installed inside the rail 100 and a second fixing portion partly extended out of the rail 100, wherein the second main part 501 is fixed with the second fixing plate 504 at the second fixing portion by the second fixing device 501, and the belt 300 is gripped in the second groove portion. Preferably, the second retaining structure is integrally-formed or formed by fixing the second gripping portion 503 and the second fixing plate 504 by a screw.

Figure 2:
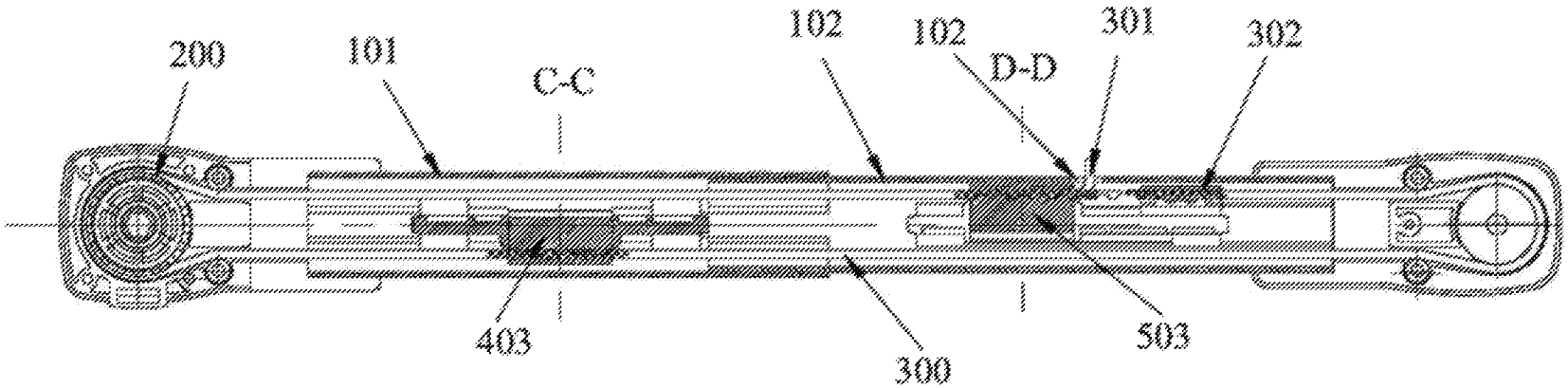
FIG. 2 is a cross sectional view of a telescopic rail in extended state of an embodiment according to the present invention.
Figure 3:
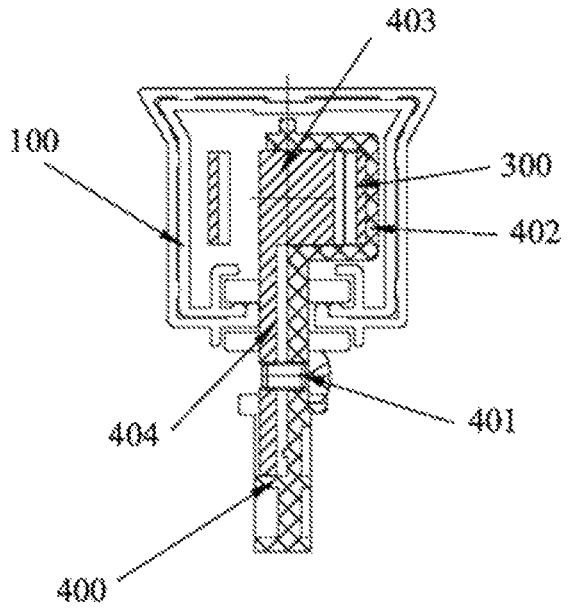
FIG. 3 is a cross sectional view taken along line A-A of FIG. 1.
Figure 4:
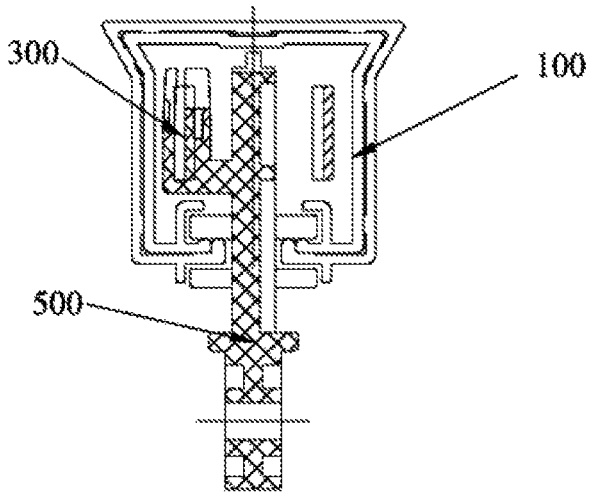
FIG. 4 is a cross sectional view taken along line B-B of FIG. 1.
Figure 5:
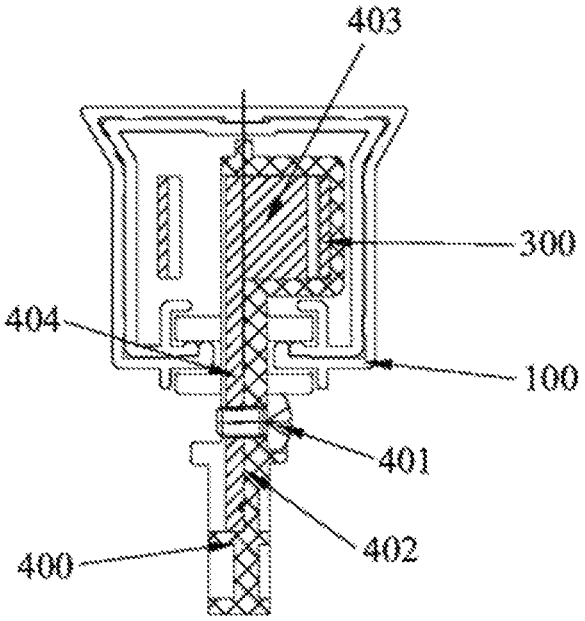
FIG. 5 is a cross sectional view taken along line C-C of FIG. 2.
Figure 6:
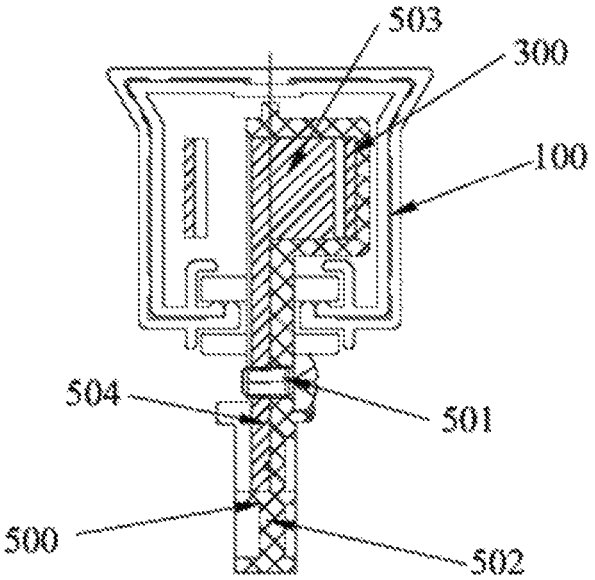
FIG. 6 is a cross sectional view taken along line D-D of FIG. 2.

There are two work conditions of the telescopic rail, wherein the telescopic rail of the first work condition is in a contractive state as illustrated in FIGS. 1, 3 and 4 and the telescopic rail of the second work condition is in an extended state as illustrated in FIGS. 2, 5 and 6. In contractive state, the fixed end 302 of the belt 300 is fixed to the second traction block 500, and other part of the belt 300 is released from both of the first gripping portion 403 and the second gripping portion 503, then hold the free end 301, after the rail is extended to a total length of the rail that is qualified for requirements, tightening the first fixing device 401 and the second fixing device 501 to grip and secure the belt 300 by the first gripping portion 403 and the second gripping portion 503.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A telescopic rail, comprising rails, including a first rail and a second rail which is slidably arranged inside the first rail;

two rotating wheels, being respectively arranged at the two ends of the rails;

a belt, wrapping around the outer periphery of the two rotating wheels, having a free end and a fixed end;

a first traction block, being arranged at the middle of the belt, wherein the first traction block comprises a first fixing device by which the first traction block could grip or release the belt; and a second traction block, being configured to grip the two ends of the belt, wherein the second traction block comprises a second fixing device by which the second traction block could grip or release the belt;

wherein the fixed end is fixed by the second traction block, and the free end is gripped by the second traction block and then extends out of the second rail via a through-hole on the second rail.

2. The telescopic rail of claim 1, wherein the belt is a timing belt.

3. The telescopic rail of claim 2, wherein the first traction block comprises a first main part and a first retaining structure, the first retaining structure comprises a first fixing plate and a first gripping portion for gripping the belt, the belt is gripped between the first main part and the first gripping portion, and the first fixing plate is fixed with the first main part by the first fixing device.

4. The telescopic rail of claim 3, wherein the first main part comprises a first groove portion installed inside the rail and a first fixing portion extended out of the rail, the first main part is fixed with the first fixing plate at the first fixing portion by the first fixing device, and the belt is gripped in the first groove portion.

5. The telescopic rail of claim 4, wherein the first fixing device is a screw.

6. The telescopic rail of claim 2, wherein the second traction block comprises a second main part and a second retaining structure, the second retaining structure comprises a second fixing plate and a second gripping portion for gripping the belt, the belt is gripped between the second main part and the second gripping portion, and the second fixing plate is fixed with the second main part by the second fixing device.

7. The telescopic rail of claim 6, wherein the second main part comprises a second groove portion installed inside the rail and a second fixing portion extended out of the rail, the second main part is fixed with the second fixing plate at the second fixing portion by the second fixing device, and the belt is gripped in the second groove portion.

8. The telescopic rail of claim 7, wherein the second fixing device is a screw.

* * * * *